United States Patent [19]

Stegens

[11] 4,253,073

[45] Feb. 24, 1981

[54] SINGLE GROUND PLANE INTERDIGITAL BAND-PASS FILTER APPARATUS AND METHOD

[75] Inventor: Ronald E. Stegens, Brookeville, Md.

[73] Assignee: Communications Satellite Corporation, Washington, D.C.

[21] Appl. No.: 934,460

[22] Filed: Aug. 17, 1978

[51] Int. Cl.[3] ..... H01P 7/08; H01P 1/205; H01P 1/203

[52] U.S. Cl. ..... 333/203; 333/204; 333/246

[58] Field of Search ..... 333/73 R, 73 C, 73 S, 333/73 W, 82 R, 83 A, 83 R, 98 R, 202, 203, 204, 205, 219, 246

[56] References Cited

U.S. PATENT DOCUMENTS

| | | | |
|---|---|---|---|
| 3,327,255 | 6/1967 | Bolljhan et al. | 333/73 C |
| 3,348,173 | 10/1967 | Matthaei et al. . | |
| 3,588,757 | 6/1971 | Andrascek | 333/73 S |
| 4,020,428 | 4/1977 | Friend et al. . | |

OTHER PUBLICATIONS

Grieg et al-"Microstrip-A New Transmission Technique for the Kilomegacycle Range", Proc. I.R.E., vol. 40, Dec. 1952; pp. 1644-1650.

Matthaei-"Microwave Filters, Impedance-Matching Networks, and Coupling Structures", McGraw-Hill, New York, 1964; pp. 614-634.

Cristal-"New Design Equations for a Class of Microwave Filters", IEEE Trans. on Microwave Theory and Techniques, vol. MTT-19, No. 5, May 1971; pp. 486-490.

Bryant et al.-"Parameters of Microstrip Transmission Lines and Coupled Pairs of Microstrip Lines", IEEE Trans. on Microwave Theory and Techniques, vol. MTT-16, Dec. 1968; pp. 1007-10012.

Cristal-"Tapped-Line Coupled Transmission Lines with Applications to Interdigital and Combline Filters", IEEE Trans. on Microwave Theory and Techniques, vol. MTT-23, No. 12, Dec. 1975; pp. 1007-10012.

Milligan, "Dimensions of Microstrip Coupled Lines & Interdigital Structures", in IEEE Trans. on MTT, May 1977, pp. 405-410.

*Primary Examiner*—Marvin L. Nussbaum

*Attorney, Agent, or Firm*—Sughrue, Rothwell, Mion, Zinn and Macpeak

[57] ABSTRACT

A method of fabrication and apparatus are disclosed for realizing a high-frequency non-transverse electromagnetic (non-TEM) mode interdigital band-pass filter. The filter has interdigital microstrip resonators $R_i$ separated a constant distance H from a ground plane by a propagation medium. The method of fabrication allows the $W_i/H_i$ and $S_{i,i+1}/H_i$ dimensions of the filter to be obtained. The method starts by determining the self and mutual admittance values $Y_{i,i}$ and $Y_{i,i+1}$, respectively, of each resonator $R_i$. An estimate for $W_i/H_i$ for each resonator can be made, if desired, using a single microstrip approach. The $W_i/H_i$ estimates are used to obtain the $S_{i,i+1}/H_i$ value for each adjacent pair of resonators $R_i,R_{i+1}$. The $S_{i,i+1}/H_i$ values are used to obtain the values for $Y_f$ and/or $Y_{fe}$ for each resonator $R_i$. The values for $Y_f$ and/or $Y_{fe}$ are used to calculate the value for $Y_{pp}$ for each resonator $R_i$. Each $Y_{pp}$ value is used to obtain a value for $W_i/H_i$. The method of fabrication is convergent and can be iterated to obtain convergent values for $S_{i,i+1}/H_i$ and $W_i/H_i$ so that a filter can be produced having the desired electrical passband response.

11 Claims, 16 Drawing Figures

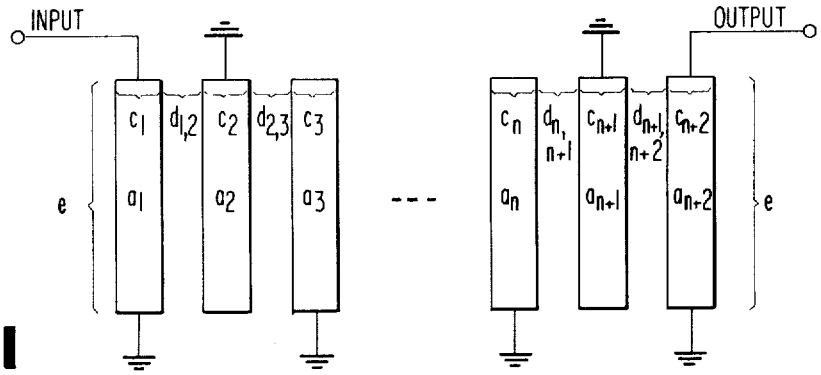
FIG 1
(PRIOR ART)
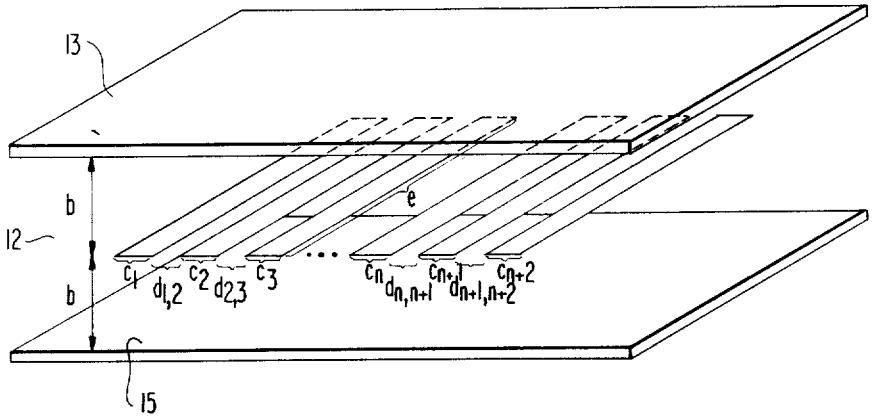
FIG 2
(PRIOR ART)
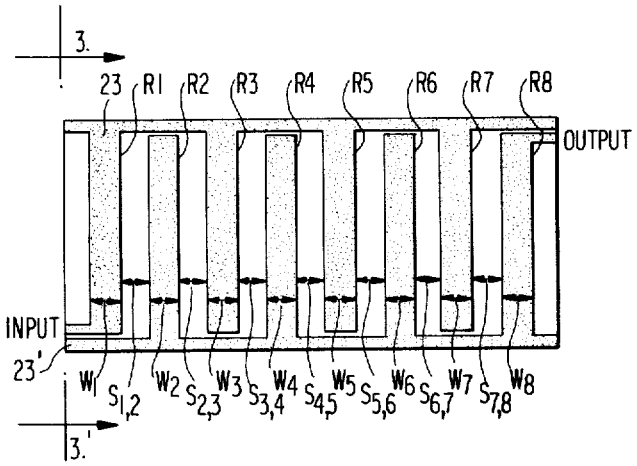
FIG 3
FIG 4
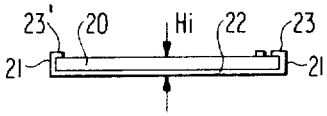

SINGLE GROUND PLANE INTERDIGITAL BAND-PASS FILTER APPARATUS AND METHOD

BACKGROUND OF THE INVENTION

1. Field Of The Invention

The present invention relates generally to high-frequency band-pass filter apparatus and methods of fabricating such filters and, more particularly, to non-TEM-mode interdigital band-pass filters and methods of fabricating such filters.

2. Prior Art

In high-frequency communication systems, the band-pass filter is a necessary, and often essential, element. A well-known example of the band-pass filter is the wave guide filter. As is well known, signal propagation through the wave guide band-pass filter is in the non-TEM mode. The physical dimensions of the filter can be realized according to known techniques. The verb "realize" as used herein means the ability to calculate the physical dimensions of the filter from a desired electrical response so that the actual electrical response produced by the filter incorporating the calculated physical dimensions closely approximates the desired electrical response.

The wave guide band-pass filter, while achieving the desired electrical response, has several major practical disadvantages. Because the wave guide band-pass filter must always be a three-dimensional structure, it is physically difficult to construct and adjust for optimum performance and is very expensive to manufacture. Moreover, the wave guide band-pass filter using an air dielectric is very large, even at super high frequencies (SHF). For example, a wave guide band-pass filter with a center frequency $f_o$ of 1 gigahertz (GHz) typically occupies a volume of at least 6"×6"×36".

Another well-known form of the band-pass filter is the transverse electromagnetic (TEM) mode filter. One group of TEM-mode band-pass filters uses interdigital resonators disposed between first and second ground planes, and are referred to herein as TEM-mode interdigital band-pass filters. Examples of TEM-mode interdigital band-pass filters are shown in U.S. Pat. Nos. 3,327,255, Bolljahn, et al.; 3,348,173, Matthaei, et al.; and 4,020,428, Friend, et al. A basic reference is D. D. Grieg and H. F. Englemann, "Microstrip—A New Transmission Technique for the Kilomegacycle Range," Proc. I.R.E., Volume 40, December 1952, pages 1644–1650.

FIGS. 1 and 2 show two views of the TEM-mode interdigital band-pass filter. FIG. 1 is a top plan view of the filter with the top ground plane removed, whereas FIG. 2 is a side perspective view of the filter. As is taught by the Bolljahn, et al. patent, a TEM-mode interdigital band-pass filter having n filter sections (where n is a positive integer) requires n+2 interdigital resonators. As shown in FIGS. 1 and 2, each interdigital resonator $a_i$ (where i goes from 1 to n+2) is rectangular in shape and has a length of dimension e and a width of dimension $c_i$. Each resonator $a_i$ has a very small depth and is typically made of electrically conductive foil. This form for resonators $a_i$ is called stripline, sandwich-line, and sometimes microstrip. However, it should be noted that the depth of each resonator $a_i$ can be increased so that each resonator $a_i$ is in the form of a cylinder, bar, etc.

Resonators $a_i$ are arranged in parallel so that they define a plane. The space separating each pair of adjacent resonators $a_i$, $a_{i+1}$ is of dimension $d_{i,i+1}$. The left-most resonator $a_1$ is the input resonator, and the right-most resonator $a_{n+2}$ is the output resonator. Because the TEM-mode interdigital band-pass filter is electrically reciprocal, the input could be resonator $a_{n+2}$ and the output could be resonator $a_1$. Each resonator $a_i$ has one grounded end which is opposite to the grounded end of the adjacent resonators $a_{i-1}$, $a_{i+1}$. This sequence of electrical connection accounts for the use of the term interdigital in the art to describe this group of filters.

Each resonator $a_i$ has an electrical length approximately equal to one quarter wavelength (hereinafter, $\lambda/4$) of the center frequency $f_o$ of the passband of the filter. A first electrical ground plane 13 is provided a distance b above the plane defined by the resonators $a_i$, and a second electrical ground plane 15 is provided a distance b below the defined plane. A dielectric 12 is provided between ground planes 13, 15. Typically, electrical side planes (not shown) are provided on either side of ground planes 13, 15 to provide the interdigital electrical connection as well as support to resonators $a_i$.

Because the resonators $a_i$ are disposed the same distance b from ground plane 13 and from ground plane 15, the E field is completely symmetrical. This field symmetry has important ramifications. Coupling in the filter is produced by the fringing electromagnetic fields between the resonators $a_i$. When a homogeneous dielectric 12 is used, the symmetrical field allows a filter to be designed in which only TEM-mode propagation occurs.

TEM-mode propagation allows the calculation of the dimensions b, $c_i$, $d_{i,i+1}$ and e of the TEM-mode interdigital band-pass filter using only several simple equations having closed-form solutions. One well-known design procedure is presented in Matthaei, Young and Jones, *Microwave Filters, Impedance—Matching Newtorks, and Coupling Structures,* McGraw-Hill Book Company, New York, 1964, at §§10.06 and 10.07. A well-known improvement on the Matthaei, et al. procedure is found in E. G. Cristal, "New Design Equations for a Class of Microwave Filters," *IEEE Transactions on Microwave Theory and Techniques,* Volume MTT-19, No. 5, May 1971, pages 486–490.

The first step in the design of a TEM-mode interdigital band-pass filter using either the Matthaei, et al. or Cristal procedures is the selection of the desired electrical passband response parameters of: $f_o$, the center frequency of the passband; $\Delta f$, the frequency size of the passband; $\delta$, the maximum ripple in dB in the passband; $\Omega_{IN}$, the input impedance of the filter; and $\Omega_{OUT}$, the output impedance of the filter. Next, the $\delta$ value is compared with charts referred to in both of the references to determine the minimum number of sections n (where n is a positive integer) that the filter must have. As is well known, the filter can have more than n sections to produce a lower $\delta$ value while still achieving a required amount of rejection at some frequency outside of the passband. The n value is then compared with additional charts referred to in both of the references to obtain the low-pass prototype values for the filter elements. These prototype values are normalized values. The desired $\Omega_{IN}$ and $\Omega_{OUT}$ are produced by appropriately multiplying the prototype values, as is well known in the art. The multiplied prototype values are then used to compute the self capacitance of each resonator $a_i$ and the mutual capacitance of each adjacent pair of resonators $a_i$, $a_{i+1}$ using either the Matthaei, et al. or Cristal procedures. The self and mutual capacitances are then used to calculate the b, $c_i$, $d_{i,i+1}$ and e physical dimensions of the TEM-mode interdigital band-pass filter.

There is considerable confusion in the art over the terms used to describe variations in physical structure of TEM-mode interdigital band-pass filters. When interdigital resonators $a_i$ have a very thin depth so that they are of the form of thin strips, the filter has been called a triplate or stripline filter. However, when the depth of the interdigital resonators $a_i$ increases to form a rod or bar, the filter has been called a sandwich, rod, or bar interdigital filter.

As stated in the patent references given above, especially Friend, et al., and as is well known in the art, the TEM-mode interdigital band-pass filter suffers from several major deficiencies. Because the filter requires that the interdigital resonators $a_i$ be disposed an equal distance b from each of the two ground planes, a support apparatus (not shown) for the interdigital resonators $a_i$ must be provided. When air or a gas is used as the homogeneous dielectric 12, the support apparatus becomes physically complex. When a solid dielectric is used as the homogeneous dielectric 12, the ground planes must be in tight physical contact at all points with the solid dielectric 12, lest non-TEM-mode propagation occurs. This tight physical contact requires numerous fasteners. A solid dielectric 12 is preferred over a gas dielectric 12 because of the very substantial size reduction in the filter that is achieved. Another major deficiency is the very close physical tolerances that are required. These tight tolerances require many manufacturing steps so as to achieve the desired electrical response. The tight tolerances result in substantial manufacturing and final optimization costs.

In order to overcome many of the disadvantages found in TEM-mode interdigital bandpass filters, it has been suggested that an interdigital bandpass filter be constructed having only one of the ground planes of the TEM-mode interdigital band-pass filter. By eliminating one of the ground planes, it was thought that manufacturing and optimization costs could be reduced substantially. See, T. A. Milligan, "Dimensions of Microstrip Coupled Lines and Interdigital Structures," *IEEE MTT*-25, No. 5, May 1977, pages 405–410.

An example of such a filter is shown in FIGS. 3 and 4, where FIG. 3 is a top plan view and FIG. 4 is an end view. Resonators $R_1$ to $R_8$ of a 6-section filter are disposed above a single electrical ground plane 22 by a solid homogeneous dielectric 20. The resonators $R_1$ to $R_8$ are connected in interdigital fashion by two electrical lines 23, 23', provided along the top and bottom edges of dielectric 20, as shown in FIG. 3. Each electrical line 23, 23' is connected to ground plane 22 by a separate electrical side strip 32, as shown in FIG. 4. Resonator $R_1$ is the input and resonator $R_8$ is the output. Because the filter is electrically reciprocal, resonator $R_8$ could be the input and resonator $R_1$ could be the output. Resonators $R_1$ to $R_8$, ground plane 22, electrical lines 23, 23' and side strips 21 are microstrip in the filter shown in FIGS. 3 and 4.

The elimination of one of the ground planes, however, means that the E field is no longer symmetrical in the filter shown in FIGS. 3 and 4. Thus, propagation is no longer in the TEM mode. As stated above, wave guide band-pass filters also operate in the non-TEM mode. However, the physical dimensions of a wave guide band-pass filter can be readily calculated because the nature of the propagation is very well understood and the design equations have closed-form solutions. The calculated physical dimensions result in a wave guide band-pass filter whose electrical response closely approximates the electrical response used to calculate the physical dimensions.

The non-TEM-mode propagation in the non-TEM-mode interdigital band-pass filter shown in FIGS. 3 and 4 prevents the use of the simple and closed-form design procedures of Matthaei, et al. or Cristal discussed above. The inventor, as well as others in the art, have used the Matthaei, et al. or Cristal procedures to calculate the physical dimensions of the non-TEM-mode interdigital band-pass filter. The calculated physical dimensions, however, produce a filter whose electrical response grossly deviates from the electrical response used to calculate the physical dimensions. Moreover, other design approaches also have failed. See the Milligan reference above. For this reason, it can be said that prior to the present invention, it has been impossible to realize a non-TEM-mode interdigital band-pass filter. The inventor has discovered a method of fabrication for determining the physical dimensions of a non-TEM-mode interdigital band-pass filter having one ground plane, whose electrical response closely approximates the electrical passband response used to determine the physical dimensions.

SUMMARY OF THE INVENTION

It is the object of the present invention to provide a method of fabrication and apparatus for realizing a non-TEM-mode interdigital band-pass filter having one ground plane.

The method of fabrication of the present invention allows the physical dimensions $W_i/H_i$ and $S_{i,i+1}/H_i$ to be obtained for a non-TEM-mode interdigital band-pass filter having one ground plane, and a filter incorporating these dimensions exhibits a passband response substantially equal to the desired passband response. An n section filter of the present invention (where n is a positive integer) has n+2 interdigital resonator $R_i$ (where i goes from 1 to n+2) separated a constant distance H from an electrical ground plane by a homogeneous dielectric. Resonators 1 and n+2 are the input and the output of the filter, respectively. The resonators are typically microstrip and are rectangular in shape. Each resonator has an electrical length approximately equal to $\lambda/4$ at the center frequency of the passband. The width $W_i$ of each resonator and the distance $S_{i,i+1}$ between each pair of adjacent resonators $R_i R_{1+1}$ are usually different values for different values of i. The values for physical dimensions $H_i$, $W_i$ and $S_{i,i+1}$ of the filter of the present invention are obtained by the iterative and convergent method of fabrication of the present invention. The method starts by determining the self and mutual capacitance values using either the Matthaei, et al. or Cristal design procedures. These self and mutual capacitances are converted to self and mutual admittances by multiplying by the speed of light. An estimate for $W_i/H_i$ for each resonator $R_i$ can be made, if desired, using a single microstrip approach and FIG. 13. The $W_i/H_i$ estimates are then used to obtain $S_{i,i+1}/H_i$ values using FIG. 11. The $S_{i,i+1}/H_i$ values are then used to obtain values for $Y_f$ and/or $Y_{fe}$ for each resonator using FIGS. 9 and 10, respectively. The values for $Y_f$ and/or $Y_{fe}$ are used to calculate the value for $Y_{pp}$ for each resonator using equations (12) and (13). The $Y_{pp}$ values are then used to obtain values for $W_i/H_i$ using FIG. 9. THe method of fabrication is convergent and can be iterated to obtain values for $S_{i,i+1}/H_i$ and $W_i/H_i$ so that a filter can be produced having the desired electrical passband response.

BRIEF DESCRIPTION OF THE DRAWINGS

FIG. 1 is a top plan view, with the top ground plane removed, of the prior art TEM-mode interdigital band-pass filter showing the physical arrangement of the resonators $a_i$ and showing their electrical connection in schematic form.

FIG. 2 is a side perspective view of the prior art TEM-mode interdigital band-pass filter shown in FIG. 1.

FIG. 3 is a top plan view of a filter of the present invention having 6 sections and 8 resonators.

FIG. 4 is a side view of the filter of FIG. 3 taken along line 3—3'.

DESCRIPTION OF THE INVENTION

Figure 5:
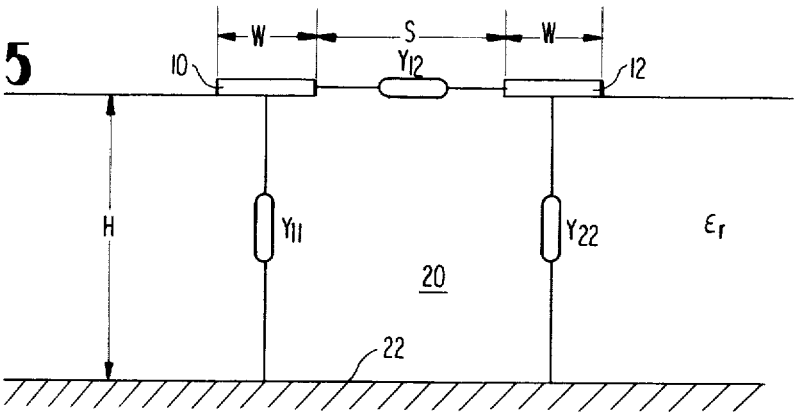
FIG. 5 is a cross-sectional view of the given structure having two parallel-coupled microstrips separated from a ground plane by a dielectric.

As stated above, the procedure for calculating the physical dimensions of the conventional TEM-mode interdigital band-pass filters was first presented by Matthaei, et al. and refined by Cristal.

The first step in the design of a conventional TEM-mode interdigital band-pass filter using either the Matthaei, et al. or Cristal procedure is the selection of the desired electrical passband response parameters of: $f_o$, the center frequency of the passband: $\Delta f$, the frequency size of the passband; $\delta$, the maximum ripple in dB in the passband; $\Omega_{IN}$, the input impedance of the filter; and $\Omega_{OUT}$, the output impedance of the filter. Next, the $\delta$ value is compared with charts referred to in both of the references to determine the minimum number of sections n that the filter must have. As is well known, the filter can have more than n sections to produce a lower $\delta$ value while still achieving a required amount of rejection at some frequency outside of the passband. The n value is then compared with additional charts referred to in both references to obtain the low-pass prototype values for the filter elements. These prototype values are normalized values. The desired $\Omega_{IN}$ and $\Omega_{OUT}$ are produced by appropriately multiplying the prototype values, as is well known in the art. The multiplied prototype values are then used to compute the self capacitance of each resonator $a_i$ and the mutual capacitance of each adjacent pair of resonators $a_i$, $a_{i+1}$ using either the Matthaei, et al. or Cristal procedures. The self and mutual capacitances are then used to calculate b, $c_i$, $d_{i,i+1}$ and e dimensions of the TEM-mode interdigital band-pass filter.

As stated above, it has been suggested that an interdigital band-pass filter having only one electrical ground plane, and, consequently, having non-TEM propagation, would reduce substantially the manufacturing and optimization costs as well as the size of a comparable conventional interdigital band-pass filter.

A n=6 section version of the proposed band-pass filter is shown in FIGS. 3 and 4. The number of sections n of the filter determines the number of interdigital resonators: there are n+2 resonators $R_i$ (where i goes from 1 to n+2). Each resonator $R_i$ is separated a distance $H_i$ from the single electrical ground plane 22 by a dielectric 23. Each resonator $R_i$ has a rectangular shape, a length of dimension L and a width of dimension $W_i$. The value of $L_i$ is chosen such that each resonator $R_i$ has an electrical length approximately equal to $\lambda/4$ at the center frequency $f_o$ of the filter passband. Each resonator $R_i$ has a very small depth and is typically made of electrically conductive foil. This form for resonators $R_i$ is called microstrip.

Resonators $R_i$ are arranged in parallel, and they define a plane when the values for $H_i$ are equal. The space separating each pair of adjacent resonators $R_i$,$R_{i+1}$ is of dimension $S_{i,i+1}$ (where i goes from 1 to n+1). The left-most resonator $R_1$ in FIG. 3 is the input resonator, and the right-most resonator $R_8$ is the output resonator. Because the filter is electrically reciprocal, the output could be resonator $R_1$ and the input could be resonator $R_8$. Each resonator $R_i$ has one grounded end which is opposite to the grounded ends of the adjacent resonators $R_{i-1}$,$R_{i+1}$. This sequence of electrical connection accounts for the use of the term interdigital to describe this filter. The interdigital connection between the resonators $R_i$ and the ground plane 22 is provided by electrical lines 23, 23' and side strips 21, as shown in FIGS. 3 and 4.

As stated above, the inventor and others in the art have used both the Matthaei, et al. and Cristal procedures to calculate the physical dimensions $H_i$, $W_i$ and $S_{i,i+1}$ of the non-TEM-mode interdigital band-pass filter of the present invention. However, the electrical response of a filter of the present invention built according to the calculated dimensions for $H_i$, $W_i$ and $S_{i,i+1}$ using either the Matthaei, et al. or Cristal procedures deviates grossly from the electrical passband response used to calculate the physical dimensions.

The inventor shows that this gross deviation in performance is caused by the phase velocity V. The phase velocity $V_i$ associated with each resonator $R_i$ is different and is unknown. The Matthaei, et al. and Cristal procedures assume that the value of each $V_i$ is known and is equal. This discovery by the inventor accounts for the gross deviation in performance of a filter of the present invention when either the Matthaei, et al. or Cristal procedures are used to determine the values for the physical dimensions $H_i$, $W_i$ and $S_{i,i+1}$.

The inventor has arrived at a method of fabrication for determining values of $H_i$, $W_i$ and $S_{i,i+1}$ so that a filter of the present invention built according to these dimensional values has an electrical response substantially equal to the desired electrical response used to make the dimensional calculation.

The generation of the graphs used by the method of the present invention to determine the physical dimensions $H_i$, $W_i$ and $S_{i,i+1}$ of a filter of the present invention is now described.

FIG. 5 shows an assumed structure having two parallel electrical microstrips 10, 12 separated a distance H from an electrical ground plane 22 by a dielectric 20. The variables shown in FIG. 5 are:

$Y_{11}$, the self admittance in mmhos between microstrip 10 and ground plane 22;

$Y_{22}$, the self admittance in mmhos between microstrip 12 and ground plane 22;

$Y_{12}$, the mutual admittance in mmhos between microstrips 10 and 12;

S, the distance between microstrips 10 and 12;

W, the width of microstrip 10 and microstrip 12;

H, the distance from ground plane 22 and microstrips 10 and 12; and $\epsilon_r$, the dielectric constant of dielectric 20.

Figure 6:
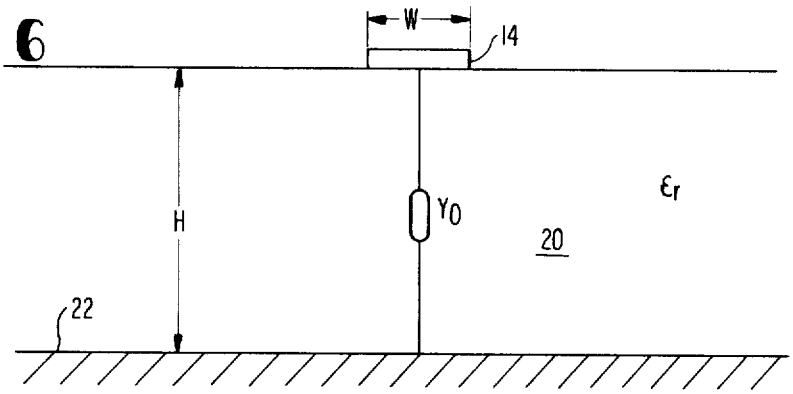
FIG. 6 is a cross-sectional view of the given structure having a single microstrip separated from a ground plane by a dielectric.

FIG. 6 shows a second assumed structure having one microstrip 14 separated by dielectric 20 from ground plane 22. Like variables in FIGS. 3 and 4 are the same. Variable $Y_o$ is the self admittance in mmhos between microstrip 14 and ground plane 22.

The reference by T. G. Bryant and J. A. Weiss, "Parameters of Microstrip Transmission Lines and Coupled Pairs of Microstrip Lines," *IEEE Trans. on Microwave Theory and Techniques,* Volume MTT-16, December 1968, pages 1021–1027, discloses a procedure for determining values for certain variables of the structures of FIGS. 3 and 4 with respect to fixed values for W, H and S: $Z_o$, the impedance between single microstrip 14 and ground plane 22; $Z_{oo}$, the odd mode impedance between microstrips 12 and 14 and ground plane 22; $Z_{oe}$, the even mode impedance between microstrips 12 and 14 and ground plane 22. Because admittance is the inverse of impedance, the corresponding admittance values $Y_o$, $Y_{oo}$ and $Y_{oe}$ for the above three variables $Z_o$, $Z_{oo}$ and $Z_{oe}$, respectively, can readily be determined.

The self and mutual admittance variables of the structures of FIGS. 5 and 6 are not valid when there are more than one pair of symmetrical microstrips 12 and 14. Therefore, in order to determine the physical dimensions $H_i$, $W_i$ and $S_{i,i+1}$ of the filter of the present invention, the self and mutual admittance variables of the structures of FIGS. 5 and 6 must be broken out into their component admittance variables in order to generate the graphs used by the method of fabrication of the present invention to calculate values for $H_i$, $W_i$ and $S_{i,i+1}$.

Figure 8:
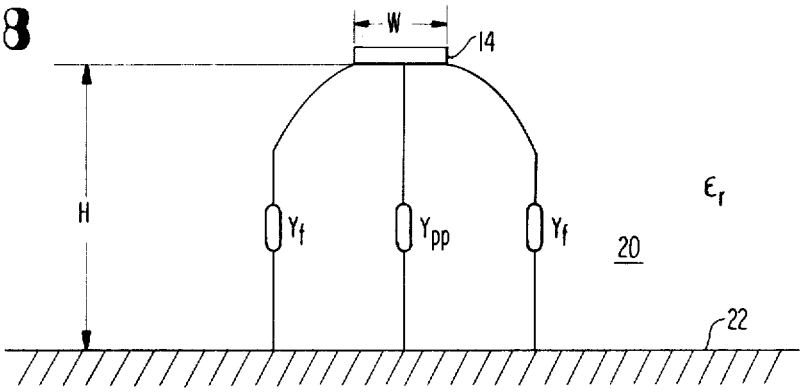
FIG. 8 shows the structure of FIG. 6 with the self admittance $Y_o$ broken out into its component admittance variables.

Referring first to the single microstrip structure of FIG. 6, the variable $Y_o$ (the admittance in mmhos between microstrip 14 and ground plane 22) can be broken out into the following admittance component variables shown in FIG. 8 and given by the following equation:

$$Y_o = 1/Z_o = Y_{pp} + 2Y_f \tag{1}$$

where:

$Z_o$ is the impedance in ohms between microstrip 14 and ground plane 22 with respect to fixed values for H and W given by the Bryant and Weiss references above;

$Y_{pp}$ is the parallel-plate admittance in mmhos between microstrip 14 and ground plane 22; and $Y_f$ is the fringing admittance in mmhos between microstrip 14 and ground plane 22. p The variable $Y_{pp}$ can be calculated using the following equation:

$$Y_{pp} = (C_{pp}) \cdot (C/\sqrt{\epsilon_r}) \tag{2}$$

where:

$C_{pp}$ is the parallel-plate capacitance in Farads/meter between microstrip 14 and ground plane 22;

c is the speed of light, $c = 3 \times 10^8$ meters/second; and $\epsilon_r$ is the dielectric constant of dielectric 20.

The variable $C_{pp}$ is determined as follows:

$$C_{pp} = \epsilon_o \epsilon_r (W/H) \tag{3}$$

where: $\epsilon_o$ is $8.85 \times 10^{-12}$ Farads/meter.

Substituting equation (3) into equation (2) and substituting in the values for c and $\epsilon_o$ yields:

$$Y_{pp} = 2.655 \sqrt{\epsilon_r} \left(\frac{W}{H}\right) \tag{4}$$

Equation (4) shows that $Y_{pp}$ is defined in terms of W and H. $Y_{pp}$ is plotted for W/H for the given value of $\epsilon_r = 10$ in FIG. 9.

The admittance variable $Y_f$ can be calculated by rearranging equation (1) so that:

$$Y_f = (Y_o - Y_{pp})/2 \tag{5}$$

Values for $Y_o$ for fixed values of W and H are determined by the procedure of Bryant and Weiss above, and values for $Y_{pp}$ for fixed values of W and H are determined using equation (4). Thus, $Y_f$ is defined in terms of W and H. $Y_f$ is plotted for W/H for the given value of $\epsilon_r = 10$ in FIG. 9.

The inventor has determined that the self admittance variables $Y_{11}$ and $Y_{22}$ of the structure of FIG. 5 are each equal to the $Y_{oe}$ admittance variable determined by the Bryant and Weiss procedure above. Each self admittance $Y_{11}$ or $Y_{22}$ can be broken out into the admittance components shown in FIG. 7 and given by the following equation, where $Y_{oe}$ has been substituted for $Y_{11}$ or $Y_{22}$:

$$Y_{oe} = Y_f + Y_{pp} + Y_{fe} \tag{6}$$

where: $Y_{fe}$ is the even mode center fringing admittance in mmhos between microstrip 10 and ground plane 22 or between microstrip 12 and ground plane 22.

Equation (6) can be rewritten to allow the values for variable $Y_{fe}$ to be computed:

$$Y_{fe} = Y_{oe} - Y_f - Y_{pp} \tag{7}$$

Unlike $Y_{pp}$ or $Y_f$ which are independent of S, $Y_{oe}$ is defined in terms of W, H and S. Values for $Y_{oe}$ for fixed values of W, H and S are determined by the procedure of Bryant and Weiss above. Values for $Y_{pp}$ for fixed values of W and H are determined using equation (4) above, and values for $Y_f$ for fixed values of W and H are determined using equation (5) above. Thus, $Y_{fe}$ is defined in terms of W, H and S. $Y_{fe}$ is plotted for S/H for arbitrary values of W/H for the given value of $\epsilon_r = 10$ in FIG. 10.

Figure 7:
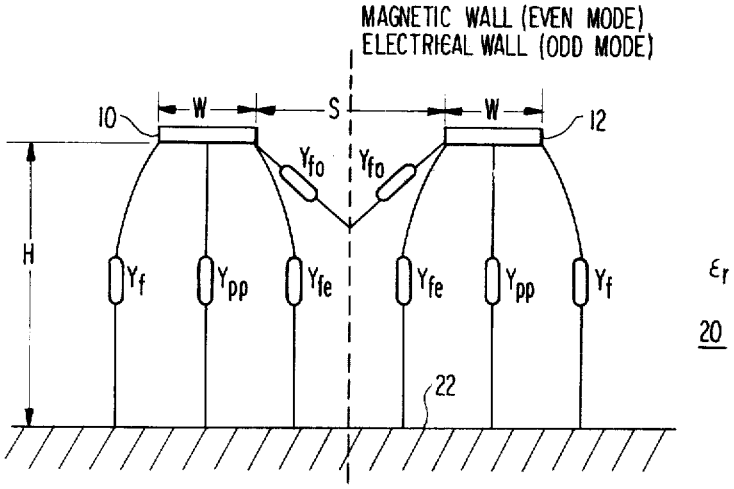
FIG. 7 shows the structure of FIG. 5 with the mutual admittance $Y_{12}$ and self admittances $Y_{11}$, $Y_{22}$ broken out into their component admittance variables.

The admittance variable $Y_{oo}$ of Bryant and Weiss can be broken out into the admittance components shown in FIG. 7 and given by the following equation:

$$Y_{oo} = Y_f + Y_{pp} + Y_{fo} \quad (8)$$

Equation (8) can be rewritten to facilitate computation of values for variable $Y_{fo}$:

$$Y_{fo} = Y_{oo} - Y_f - Y_{pp} \quad (9)$$

Unlike $Y_{pp}$ or $Y_f$ which are independent of S, $Y_{oo}$ is defined in terms of W, H and S. Values for $Y_{oo}$ for fixed values of W, H and S are determined by the procedure of Bryant and Weiss above. Values for $Y_{pp}$ for fixed values of W and H are determined using equation (4) above, and values for $Y_f$ for fixed values of W and H are determined using equation (5) above. Thus, $Y_{fo}$ is defined in terms of W, H and S.

The mutual admittance variable $Y_{12}$ shown in FIG. 5 relates to the admittance variables $Y_{oo}$ and $Y_{oe}$ as follows:

$$Y_{12} = \tfrac{1}{2}(Y_{oo} - Y_{oe}) \quad (10)$$

Substituting equations (6) and (8) into equation (10) yields:

$$Y_{12} = \tfrac{1}{2}(Y_{fo} - Y_{fe}) \quad (11)$$

As stated above, both $Y_{fo}$ and $Y_{fe}$ are defined in terms of W, H and S. Values for $Y_{fo}$ for fixed values of W, H and S are determined using equation (9) above, and values for $Y_{fe}$ for fixed values of W, H and S are determined using equation (7) above. Thus, $Y_{12}$ is defined in terms of W, H and S. $Y_{12}$ is plotted for S/H for arbitrary values of W/H for the given value of $\epsilon_r = 10$ in FIG. 11.

The above calculations and plotted admittances are used to determine the values of the physical dimensions $H_i$, $W_i$ and $S_{i,i+1}$ for the non-TEM-mode interdigital band-pass filter of the present invention, as shown in FIGS. 3 and 4. It should be noted that the graphs need only be plotted once and that interpolation can be done to obtain needed values.

It should be noted that each of the $H_i$ dimensions are selected to be equal so that the resonators $R_i$ all lie in the same plane. In addition, the value of $\epsilon_r$ of the dielectric 20 is chosen to be constant. One excellent material for dielectric 20 is alumina ($Al_2O_3$), which typically has an $\epsilon_r = 10$. Resonators $R_i$, ground plane 22, lines 23, 23' and side planes 21 typically are made of gold (Au), but any electrically conductive material can be used.

Figure 12:
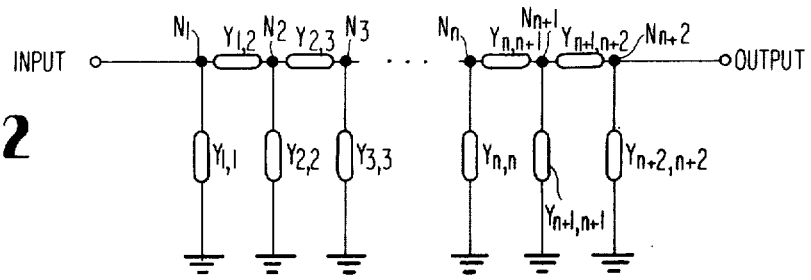
FIG. 12 is a diagram representing the filter of the present invention in terms of self admittances $Y_{i,i}$ and mutual admittance $Y_{i,i+1}$.

The breaking out of the mutual admittance $Y_{12}$ and the self admittances $Y_{12}$ and $Y_{22}$ into their component admittance variables allows the filter of the present invention to be described completely, as shown in FIG. 12, using only the self admittance of each resonator $R_i$ and the mutual admittance between each adjacent pair of resonators $R_i$, $R_{i+1}$. Each mode $N_i$ (where i goes from 1 to n+2) represents the corresponding resonator $R_i$ in a filter of the present invention having n sections and n+2 resonators. The self admittance of each resonator $R_1$ is represented by the corresponding $Y_{i,i}$. The mutual admittance between each adjacent pair of resonators $R_i R_{i+1}$ is represented by the corresponding $Y_{i,i+1}$. The self admittances $Y_{i,i}$ and the mutual admittances $Y_{i,i+1}$ are used by the method of fabrication of the present invention to determine the values of the physical dimensions $H_i$, $W_i$ and $S_{i,i+1}$ of the filter of the present invention.

The method of fabrication of the filter of the present invention is now presented. The following desired electrical passband parameters for the filter are selected: $f_o$, $\Delta f$, $\delta$, $\Omega_{IN}$ and $\Omega_{OUT}$. Using either the Matthaei, et al. or the Cristal procedure discussed above for TEM-mode interdigital bandpass filters, the required n+2 self and n+1 mutual capacitance values are computed as if the filter of the present invention was a TEM-mode interdigital band-pass filter.

Each of the required self capacitance and mutual capacitance values are multiplied by the velocity of light c, where $c = 3 \times 10^8$ meters/second, so as to transform self and mutual capacitance values into corresponding self admittance $Y_{i,i}$ and mutual admittance $Y_{i,i+1}$ values.

Initially, any value for $W_i/H_i$ can be used. As is described, values for $W_i/H_i$ and $S_{i,i+1}/H_i$ are iterative and convergent. However, it is preferred to estimate the initial value of $W_i/H_i$ using FIG. 13, which plots single microstrip self admittance $Y_o$ in mmhos versus $W_i/H_i$. The plot of FIG. 13 was generated using the Bryant and Weiss procedure above. The initial estimates for $W_i/H_i$ (where i goes from 1 to n+2) are obtained by using the corresponding required self admittance $Y_{i,i}$ values above as the $Y_o$ values.

Figure 11:
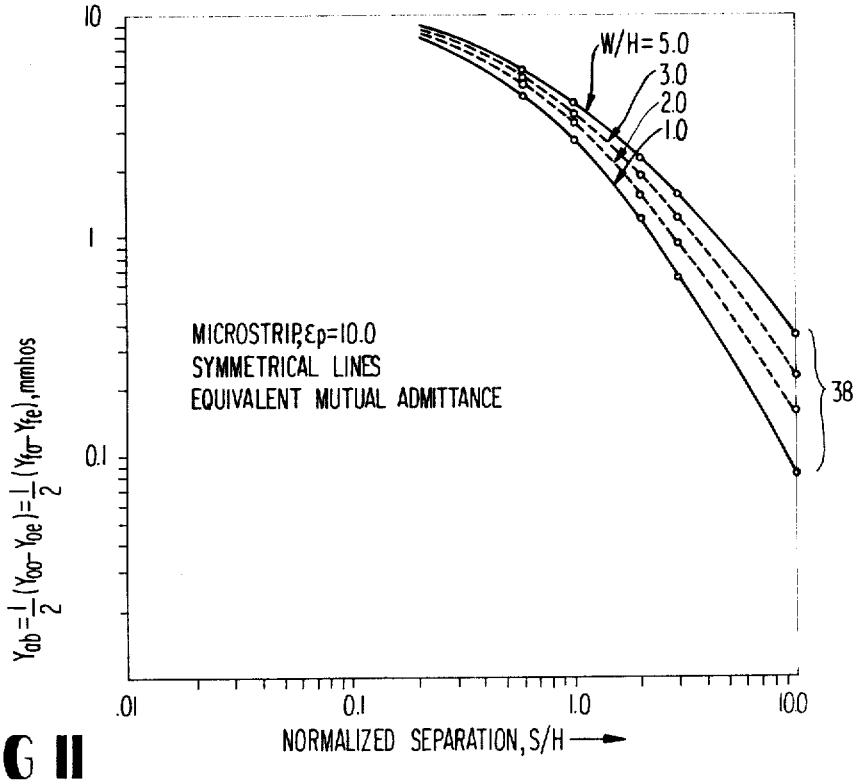
FIG. 11 is a graph plotting values of the mutual admittance $Y_{12}$ in mmhos on the vertical axis for fixed values of W/H with respect to values of S/H on the horizontal axis when $\epsilon_r=10$.

The fourth step of the method is to obtain a value of $S_{i,i+1}/H_i$ for each pair of adjacent resonators $R_{i;l\ Ri+1}$ from the plot in FIG. 11 using the previously calculated required mutual admittance value $Y_{i,i+1}$ and the initial $W_i/H_i$ value.

Figure 9:
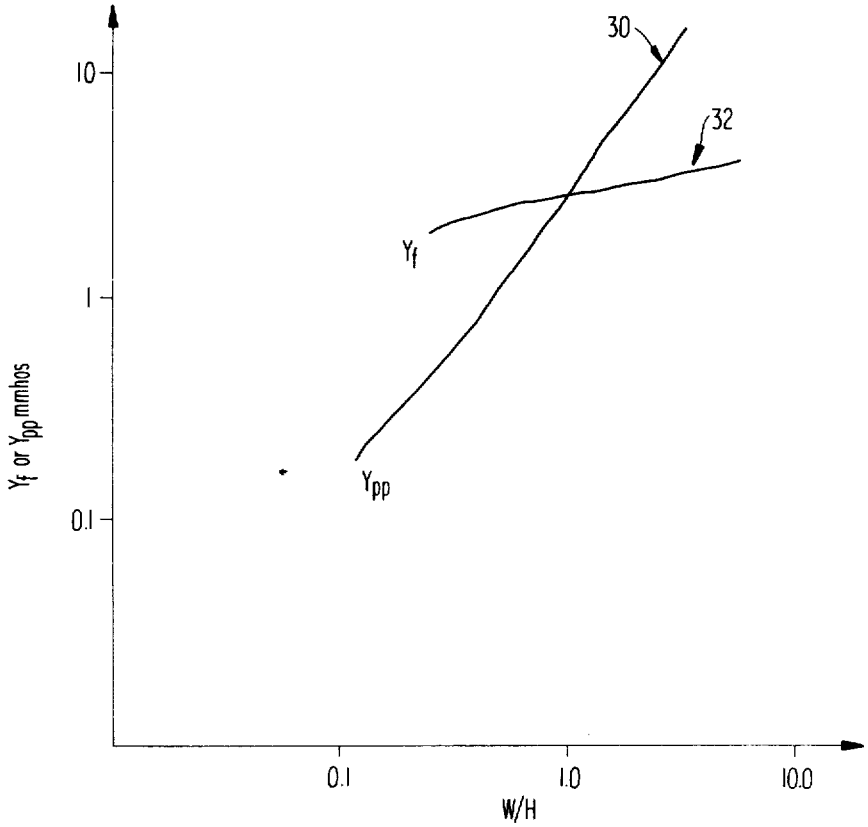
FIG. 9 is a graph plotting values of $Y_f$ and of $Y_{pp}$ in millimhos (mmhos) on the vertical axis with respect to values of W/H on the horizontal axis when $\epsilon_r=10$.
Figure 10:
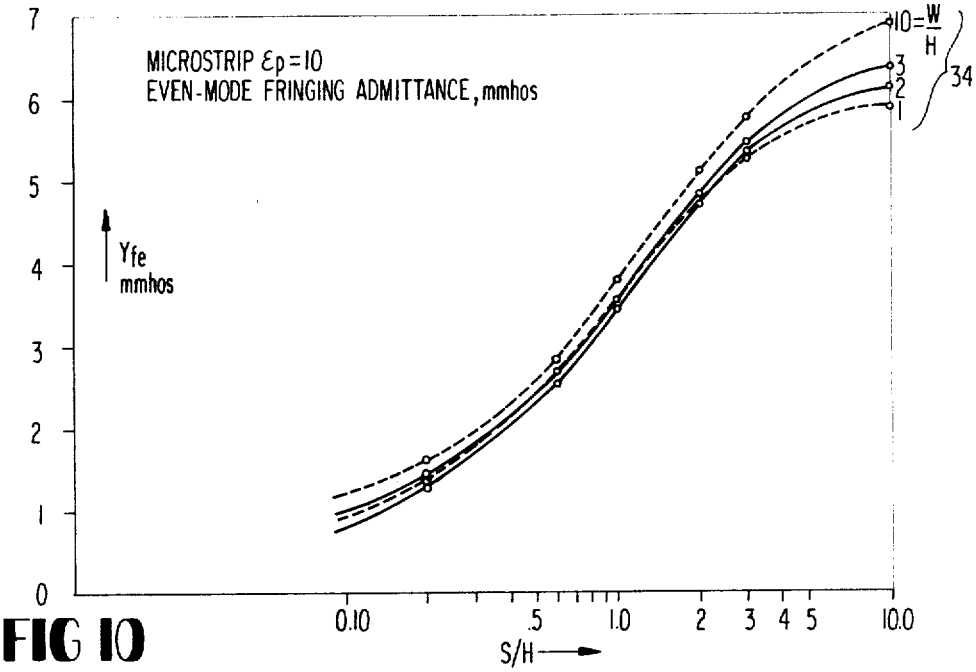
FIG. 10 is a graph plotting values of $Y_{fe}$ in mmhos on the vertical axis for fixed values of W/H with respect to values of S/H on the horizontal axis when $\epsilon_r=10$.

Next, the values of $Y_{fe}$ for each resonator $R_i$ is obtained from FIG. 10 based on the above values of $W_i/H_i$ and $S_{i,i+1}/H_i$. Also, the values of $Y_f$ for resonators $R_1$ and $R_{n+2}$ are obtained from FIG. 9 based on the above values of $W_i/H_i$.

The sixth step is to calculate the value of $Y_{pp}$ for each resonator $R_{i,i}$ using equations (12) and (13) below based on the above values of $Y_{fe}$, $Y_f$ and the required values of $Y_{i,i}$.

$$Y_{pp} = Y_{ii} - Y_f - Y_{fe} \text{ for } i = 1, n+2 \quad (12)$$

$$Y_{pp} = Y_{ii} - Y_{fei,i+1} - Y_{fei,i-1} \text{ for } i = 2, 3 \ldots n+1 \quad (13)$$

The seventh step is to obtain a value of $W_i/H_i$ for each resonator $R_i$ from FIG. 9 based on the above desired values of $Y_{pp}$.

The method can be stopped after going through steps 1–7 only once. However, since the method is an iterative and converging one, the actual filter response gets closer to the desired response each time the $W_i/H_i$ and $S_{i,i+1}/H_i$ values from step (7) are substituted back into step (4) and the method from step (4) to step (7) is repeated. The inventor has found that the iteration can be stopped when the values of the corresponding $W_i/H_i$ and $S_{i,i+1}/H_i$ from the present and immediately previous iterations are within 1% of each other. The inventor has noted rapid convergence of the $W_i/H_i$ and $S_{i,i+1}/H_i$ values and attributes this to the fact that the mutual admittance $Y_{i,i+1}$ is heavily influenced only by $S_{i,i+1}/H_i$.

As stated above, the physical length $L_i$ of each resonator $R_i$ is made to be approximately equal to the electrical $\lambda/4$ at the center frequency $f_o$ of the filter, and is calculated using a single microstrip approach. The final $W_i/H_i$ value for each resonator $R_i$ is used to obtain a single bar velocity $v_{i,i}$ value using the Bryant and Weiss procuedure above. The length $L_i$ in inches for the resonator $R_i$ is calculated using the following equation:

$$L_i = v_{i,i}/4f_o \tag{14}$$

The inventor has determined that for each resonator $R_i$ there is an end fringing capacitance $C_{fei}$ from the unshorted end of the resonator $R_i$ to ground plane 22, and a ground proximity capacitance $C_{gpi}$ from the unshorted end of the resonator $R_i$ to the adjacent line 23 or 23'. $C_{fei}$ and $C_{gpi}$ result in resonator $R_i$ appearing to be longer than an $\lambda/4$ at the center frequency $f_o$.

To calculate the amount $z_{fei}$ that the resonator $R_i$ must be shortened to compensate for $C_{fei}$, the fringing capacitance value in dielectric 20 is first multiplied by the value of $W_i/H_i$ to obtain the value for $C_{fei}$. The value for $C_{fei}$ is then used to calculate the fringing susceptance value $B_{fei}$ using the following equation:

$$B_{fei} = (2\pi f_o)(C_{fei}) \tag{15}$$

where:

$B_{fei}$ is in mmhos.

The value for $z_{fei}$, as expressed in radians at the center frequency $f_o$, is calculated using the following equation:

$$z_{fei} = \mathrm{Tan}^{-1}(B_{fei}/Y_{i,i}) \approx B_{fei}/Y_{i,i} \tag{16}$$

The inventor has found that an acceptable value for $z_{gpi}$, where $z_{gpi}$ is the amount expressed in radians at the center frequency $f_o$ that the resonator $R_i$ must be shortened to compensate for $C_{gpi}$, can be obtained by using the value given by equation (14) above. Thus, resonator $R_i$ must be shortened by an amount equal to twice $z_{fei}$ to compensate for $C_{fei}$ and for $C_{gpi}$.

Figure 14:
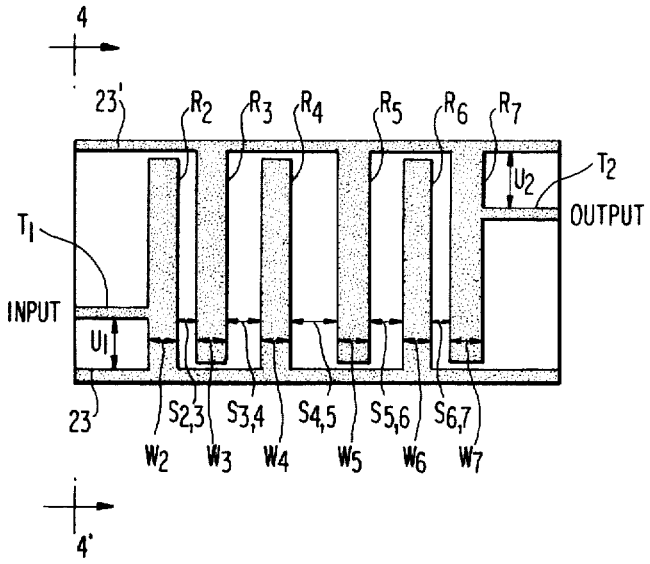
FIG. 14 is a top plan view of the filter of the present invention where the first and last resonators have been replaced with taps $T_1$, $T_2$, respectively.
Figure 15:
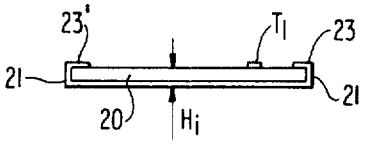
FIG. 15 is a side view of the filter of FIG. 14 taken along line 4—4'.

Resonators $R_1$ and $R_{n+2}$ only serve as impedance converters and can be eliminated so as to reduce the size of the filter by using electrical taps $T_1$ and $T_2$ on resonators $R_2$ and $R_{n+1}$, respectively, as shown in FIGS. 14 and 15. Like references in FIGS. 3 and 4 and FIGS. 14 and 15 are the same, and the values $W_i/H_i$ and $S_{i,i+1}/H_i$ are computed as described above. It should be noted, however, that the use of taps $T_1$ and $T_2$ will result in a higher ripple $\delta$ value in the filter passband. The tapping procedure was first presented in E. G. Cristal, "Tapped-Line Coupled Transmission Lines with Applications to Interdigital and Combine Filters," *IEEE MTT*-23, N. 12, December 1975, pages 1007-1012. The distance $U_1$ that tap $T_1$ must be from the shorted end of resonator $R_2$ at line 23, and the distance $U_2$ that tap $T_2$ must be from the shorted end of resonator $R_7$ at line 23' is computed as follows.

The value for y (where y is a quantity used in the computation) is calculated for $T_1$ using equation (17) below and for $T_2$ using equation (18) below:

$$y_1 = \frac{Y_{22} - (Y_{23})^2/Y_{33}}{G_{L1}} \tag{17}$$

-continued $$y_2 = \frac{Y_{n+1,n+1} - (Y_{n,n+1})^2/Y_{n,n}}{G_{L2}} \tag{18}$$

where: $G_{L1}$ in equation (17) is the input admittance of the filter and $G_{L2}$ in equation (18) is the output admittance of the filter.

The impedance transformation ratio $r_1$ for resonator $R_1$ is computed using equation (19) below and $r_2$ for resonator $R_{n+2}$ using equation (20) below:

$$r_1 = \left[\frac{(Y_{1,1})}{Y_{1,2}}\right]^2 \tag{19}$$

$$r_1 = \left[\frac{(Y_{n+2,n+2})}{Y_{n+1,n+2}}\right]^2 \tag{20}$$

The value for A (where A is a quantity used in the computation) is calculated for $T_1$ using equation (21) below with the above corresponding y and r values, and is calculated for $T_2$ using equation (22) below with the above corresponding y and r values:

$$A_1 = (r_1 + 1/y_1^2 - 2)/2 \tag{21}$$

$$A_2 = (r_2 + 1/y_2^2 - 2)/2 \tag{22}$$

The value for $\omega$ (where $\omega$ is a quantity used in the computation) is calculated for $T_1$ using equation (23) below with the above corresponding A and r values, and is calculated for $T_2$ using equation (24) below with the above corresponding A and r values:

$$\omega_1^2 = A_1 + \sqrt{A_1^2 + (r_1 - 1)} \tag{23}$$

$$\omega_2^2 = A_2 + \sqrt{A_2^2 + (r_2 - 1)} \tag{24}$$

The tap point as expressed in degrees at the center frequency $f_o$ of the passband is calculated for $T_1$ using equation (25) below with the above corresponding $\omega$ value, and for $T_2$ using equation (26) below with the above corresponding $\omega$ value:

$$U_1 = \mathrm{Cot}^{-1}(\omega_1) \tag{25}$$

$$U_2 = \mathrm{Cot}^{-1}(\omega_2) \tag{26}$$

The susceptance correction required for resonator $R_2$ is calculated using equation (27) below with the above corresponding $\omega$ and y values, and for resonator $R_{n+1}$ using equation (28) below with the above corresponding $\omega$ and y values:

$$\frac{\Delta B_1}{G_L} = \frac{(\omega_1/Y_1)}{(1 + \omega_1^2)^2 + (\omega_1^2/Y_1)^2} \tag{27}$$

$$\frac{\Delta B_2}{G_L} = \frac{(\omega_2/Y_2)}{(1 + \omega_2^2)^2 + (\omega_2^2/Y_2)^2} \tag{28}$$

The new self admittance value for $Y_{2,2}$ called $Y'_{2,2}$ is calculated using equation (29) below together with the corresponding above $\Delta B$ value, and the new self admittance value for $Y_{n+1,n+1}$ called $Y'_{n+1,n+1}$ is calculated using equation (30) below together with the corresponding above $\Delta B$ value:

$$Y'_{2,2} = Y_{2,2} + \Delta B_1 \tag{29}$$

$$Y'_{n+1,n+1} = Y_{n+1,n+1} + \Delta B_2 \quad (30)$$

For purposes of explanation, the design of a non-TEM-mode interdigital band-pass filter using the method of fabrication of the present invention is presented below. The desired filter has the fabrication material and electrical passband response parameters shown in Table 1.

TABLE 1

| | |
|---|---|
| Filter type | Chebyshev |
| Substrate type | Alumina ($Al_2O_3$) |
| Resonator material | Gold (Au) |
| $\epsilon_r$, dielectric constant for dielectric 20 | 10 |
| $f_o$, center frequency | 1.150 GHz |
| $\Delta f$, passband size | 80 MHz |
| $\delta$, ripple in passband | .01 dB |
| n, number of sections (Cristal taps $T_1$ and $T_2$ to be used) | 5 sections |
| $\Omega_{IN}$, input impedance in ohms | 50 ohms |
| $\Omega_{OUT}$, output impedance in ohms | 50 ohms |
| H | .050 inches |

Using either the Matthaei, et al. or the Cristal synthesis procedure discussed above for TEM-mode interdigital band-pass filters, the self and mutal capacitances (normalized to $\sqrt{\epsilon_r}$) are determined to be:

| | |
|---|---|
| $C_{11} = C_{77} = 66.7$ pf/m | $C_{12} = C_{67} = 23.7$ pf/m |
| $C_{22} = C_{66} = 124.9$ pf/m | $C_{23} = C_{56} = 6.40$ pf/m |
| $C_{33} = C_{55} = 116.5$ pf/m | $C_{34} = C_{45} = 4.43$ pf/m |
| $C_{44} = 116.5$ pf/m | |

The self and mutual capacitances are then converted to free-space self and mutual admittances, respectively, by multiplying each capacitance by the speed of light c, where $c = 3 \times 10^8$ meters/second.

| | |
|---|---|
| $Y_{11} = Y_{77} = 20.0$ mmhos | $Y_{12} = Y_{67} = 7.1$ mmhos |
| $Y_{22} = Y_{66} = 37.5$ mmhos | $Y_{23} = Y_{56} = 1.92$ mmhos |
| $Y_{33} = Y_{55} = Y_{44} = 34.9$ mmhos | $Y_{34} = Y_{45} = 1.33$ mmhos |

Resonators 1 and 7 are now eliminated by taps $T_1$ and $T_2$ using the Cristal tapping procedure discussed above. Because the values of $\Omega_{IN}$ and $\Omega_{OUT}$ are equal and the filter is symmetrical, the calculations for $T_1$ and $T_2$ are equal, and only $T_1$ will be calculated here. The value for y is computed using equation (17) above:

$$y = 1.8697$$

The value for r is computed using equation (19) above:

$$R = 7.935$$

Substituting the above values for r and y into equation (21) yields the value for A:

$$A = 3.1105$$

Substituting the above values for A and r into equation (23) yields the value for $\omega$:

$$\omega = 2.68$$

Each tap point $U_1$ and $U_2$ expressed in electrical degrees at the center frequency $f_o$ is calculated by substituting the above value of $\omega$ into equation (25):

$$\theta_2 = 20.5°$$

The susceptance correction required for each resonator $R_2$ and $R_6$ is determined by substituting the above values of $\omega$ and y in equation (27):

$$\Delta B/G_L = 0.0208$$

$$\Delta B = +0.416 \text{ mmhos}$$

The new self admittance values $Y'_{22}$ and $Y'_{66}$ are determined by substituting the above value of $\Delta B$ into equation (29):

$$Y'_{22} \text{ or } Y'_{66} = 37.9 \text{ mmhos}$$

Figure 13:
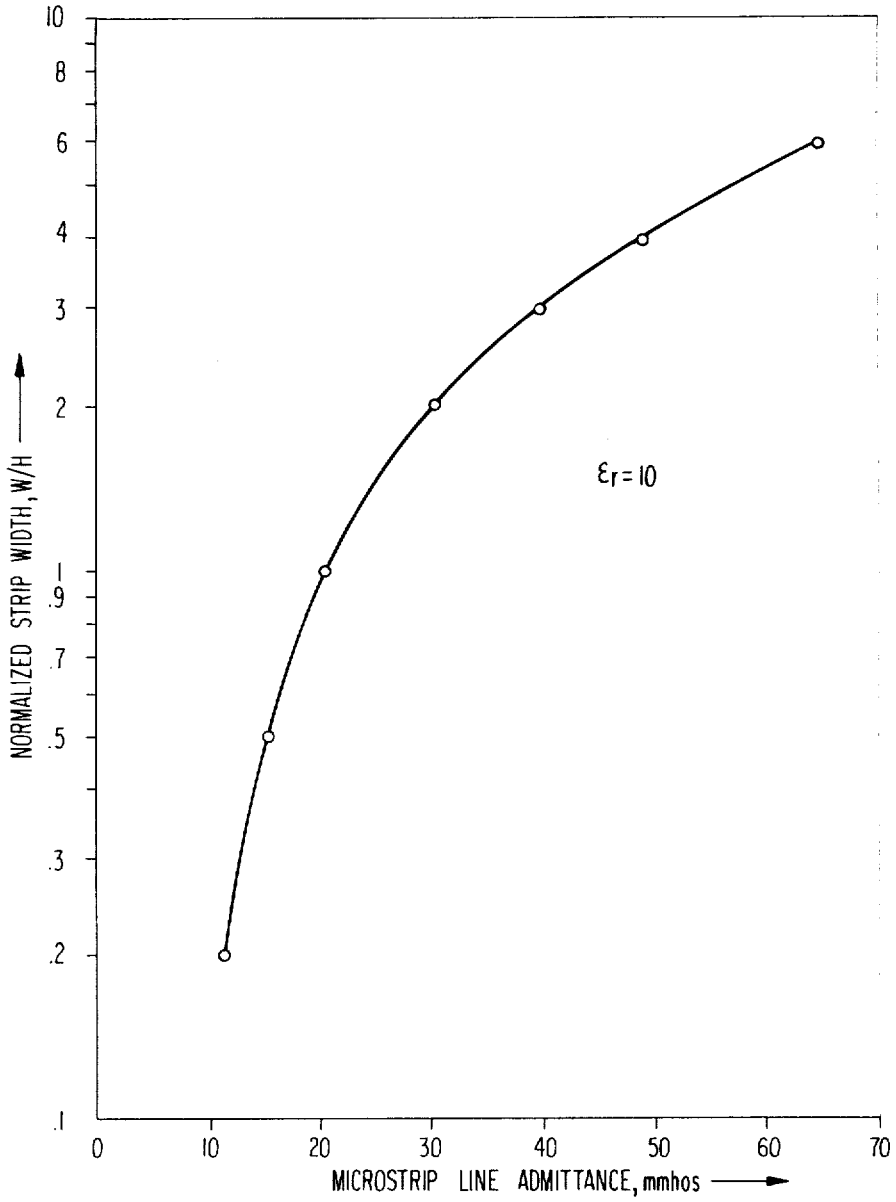
FIG. 13 is a graph plotting values of $Y_o$ for the single strip of FIG. 6 in mmhos on the horizontal axis with respect to values of W/H on the vertical axis when $\epsilon_r=10$.

Now that the computations necessary for taps $T_1$ and $T_2$ have been completed, the first estimate for the value of $W_i/H_i$ for each of the resonators 2–6 is made from FIG. 13 as described in step (3) above using the self admittance value $Y_o$ for each resonator together with FIG. 13. The initial estimate for W/H for each resonator is:

$$W_2/H = W_6/H = 2.9$$

$$W_3H = W_4/H = W_5/H = 2.8$$

The value of $S_{i,i+1}/H_i$ for each resonator is then obtained from FIG. 11 using the mutual admittance values $Y_{,i+1}$ and the estimates for $W_i/H_1$ given above:

$$S_{23}/H = S_{56}/H = 1.93$$

$$S_{34}/H = S_{45}/H = 2.70$$

The $W_i/H_i$ and $S_{i,i+1}/H_i$ values together with FIG. 10 allow the value or values for $Y_{fe}$ for each resonator $R_i$ to be obtained. Also, the value $Y_f$ for the end resonators 2 and 6 is obtained from FIG. 9.

resonator 2 and 6: $Y_f + Y_{fe23}32$ 11.75 mmhos resonator 3 and 5: $Y_{fe32} + Y_{fe34} = 9.25$ mmhos resonator 4: $2(Y_{fe45}) = 10.4$ mmhos Now that these values have been obtained, equation (12) or (13) allows the necessary parallel-plate admittance $Y_{pp}$ for each resonator to be determined:

$$Y_{pp2}, Y_{pp6} = 26.0 \text{ mmhos}$$

$$Y_{pp3}, Y_{pp5} = 25.0 \text{ mmhos}$$

$$Y_{pp4} = 24.6 \text{ mmhos}$$

The parallel-plate admittance $Y_{pp}$ values allow the first iteration values of W/H for each resonator to be obtained using FIG. 9, as explained with regard to step (7) above:

$$W_2/H = W_6/H = 3.10$$

$$W_3/H = W_5/H = 3.0$$

$$W_4/H = 2.92$$

The first iteration values for $W_i/H_i$ and $S_{i,i+1}/H_i$ have now been obtained. These values can be used to perform a second iteration, and additional iterations can be performed until sufficient convergence in the values for $W_i/H_i$ and $S_{i,i+1}/H_i$ takes place, as described above. In the present example, the second iteration yields the following $W_i/H_i$ and $S_{i,i+1}/H_i$ values:

$$\frac{W_2}{H} = 3.12 \qquad \frac{S_{23}}{H} = 1.92$$
$$\frac{W_3}{H} = 2.98 \qquad \frac{S_{34}}{H} = 2.70$$
$$\frac{W_4}{H} = 2.90$$

It should be noted that there is only a few percent difference between the first and second iteration values, and this shows the rapid convergence in the method that was discussed above.

As stated above, the electrical length of each resonator is $\lambda/4$ at the center frequency $f_o$ of the filter passband. However, it has been found that an additional improvement in the passband response can be achieved by shortening the length of the resonators $R_2$–$R_6$ to compensate for fringing and ground proximity capacitances $C_{fei}$ and $C_{gpi}$, respectively, as discussed above.

For resonators 2 and 6:

$$W_2/H = W_6/H = 3.12$$

$$v_{2,2} = v_{6,6} = 1.095 \times 10^8 \text{ meters/second}$$

$$L_2 = L_6 = 0.937 \text{ inches}$$

Similarly, using equation (12) above, the length for resonator 3 and for resonator 4 is:

$$L_3 = 0.940''$$

$$L_4 = 0.942''$$

To achieve more optimum filter performance, as discussed above, the length of each resonator should be adjusted to correct for $C_{fei}$ and $C_{gpi}$. Alumina typically has a fringing capacitance value of 45 pf/m. In the present example, this equals 0.17 pf for the $W_i/H_i$ value for each resonator $R_i$. The equivalent fringing susceptance value at the center frequency of the filter is 1.228 mmhos for each resonator $R_i$ using equation (13). Because the susceptance value is positive, the physical length of each of the resonators must be shortened by the amount given below as calculated using equation (14):

$$z_{fei} = 1.8 \text{ electric degrees at } f_o$$

$$z_{fei} = 0.018 \text{ inches}$$

As stated above, the value of $z_{fei}$ should be doubled to take into account $C_{gpi}$.

The method of fabrication of the present invention was used to obtain the $W_i/H_i$, $S_{i,i+1}/H_i$, $L_i$ and $U_1$, $U_2$ dimensions shown in Table 3 below based on the electrical filter response and material parameters shown in Table 2 below.

TABLE 2

| | |
|---|---|
| $f_o$ | 1.15 GHz |
| $\Delta f$ | 80 MHz |
| $\delta$ | .01 dB |
| n | 5 sections |
| filter type | Chebyshev |
| dielectric material | .050" Alumina ($Al_2O_3$) |
| microstrip material | chromium (Cr) and gold (Au) |
| $\epsilon_r$, dielectric constant | 10 |
| $\Omega_{IN}$ | 50 ohms |
| $\Omega_{OUT}$ | 50 ohms |

TABLE 3

| | |
|---|---|
| $S_{2,3}$ | .096 inches |
| $S_{3,4}$ | .135 inches |
| $S_{4,5}$ | .135 inches |
| $S_{5,6}$ | .096 inches |
| $W_{2,2}$ | .156 inches |
| $W_{3,3}$ | .149 inches |
| $W_{4,4}$ | .145 inches |
| $W_{5,5}$ | .149 inches |
| $W_{6,6}$ | .156 inches |
| $U_1$ | .216 inches |
| $U_2$ | .216 inches |
| H | .050 inches |
| $L_2 = L_6$ | .901 inches |
| $L_3 = L_5$ | .904 inches |
| $L_4$ | .906 inches |

Figure 16:
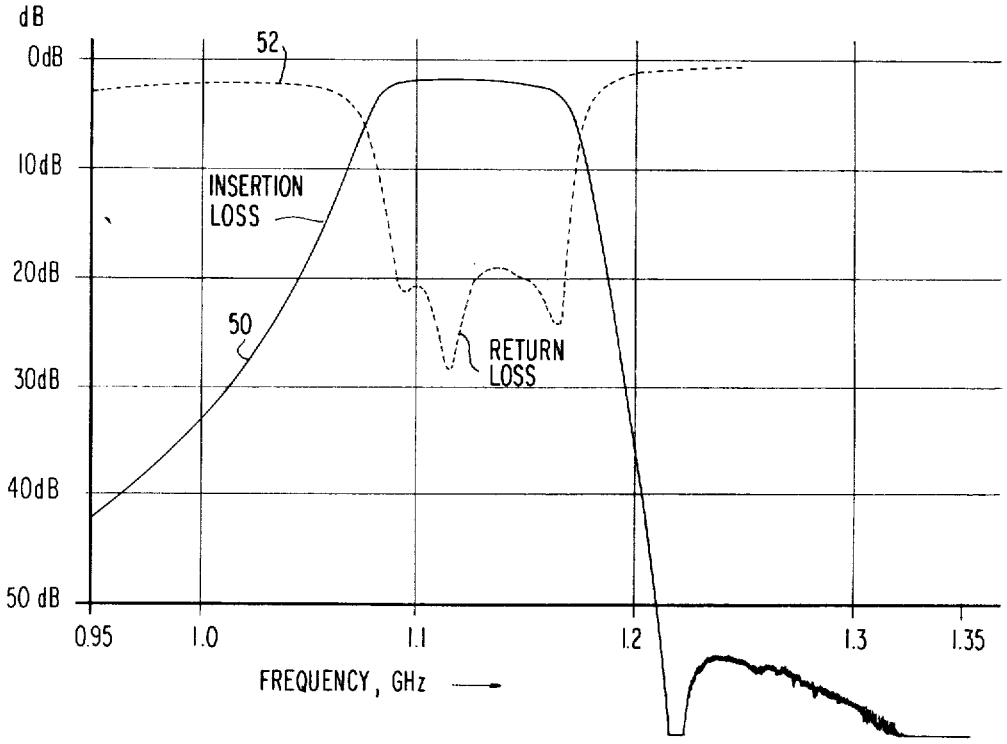
FIG. 16 is a plot of the electrical passband response of an actual filter of the present invention.

The actual passband produced by a filter constructed according to the dimensions of Table 3 is shown in FIG. 16. Line 50 shows the insertion loss in dB produced by the actual filter. The filter has an almost negligible ripple ($\delta$) value. The passband is approximately 80 MHz at 2 dB down, 110 MHz at 10 dB down, 235 MHz at 20 dB down, 180 MHz at 30 dB down, 235 MHz at 40 dB down. It has been found that the skirt at the low frequency end of the filter can be made steeper by adding electromagnetic shielding above the filter. The dotted line 52 in FIG. 16 shows the return loss (V.S.W.R.) of the filter. The large dB values inside the passband of the filter show that the filter is very well matched at the input and the output.

Thus, the method of fabrication and apparatus of the present invention allows the realization of non-TEM-mode interdigital band-pass filters of the present invention.

What is claimed is:

1. In a method of fabricating a high-frequency non-TEM-mode interdigital band-pass filter having substantially the following desired electrical characteristics of: $f_o$, where $f_o$ is the center frequency of the passband; $\delta$, where $\delta$ is the maximum ripple of the passband in dB; $\Delta f$, where $\Delta f$ is the frequency size of the passband at $\delta$; $\Omega_{IN}$, where $\Omega_{IN}$ is the filter input impedance; and $\Omega_{OUT}$, where $\Omega_{OUT}$ is the filter output impedance; and being of the type having a single electrical ground plane, a plurality of at least n resonators $R_i$ (where i goes from 1 to n) connected in interdigital fashion, resonator $R_1$ being the input and resonator $R_n$ being the output, each resonator $R_i$ being disposed a distance $H_i$ above said ground plane by a homogeneous dielectric and having a width $W_i$ and a length $L_i$, each adjacent pair of resonators $R_i$, $R_i+1$ being separated by a distance $S_{i,\,i+1}$, said method including the steps of selecting said desired electrical characteristics, calculating the dimensions $H_i$, $W_i$, $L_i$ and $S_{i,\,i+1}$ necessary to substantially achieve said desired electrical characteristics, and physically fabricating a filter structure having said calculated dimensions, the improvement characterized in that said calculating step includes the steps of:

(a) calculating the self and mutual capacitances representing each of the resonators $R_i$ based on the values of $f_o$, $\delta$, $\Delta f$, $\Omega_{IN}$ and $\Omega_{OUT}$;

(b) multiplying each of the self and mutual capacitances from step (a) by the velocity of light to obtain the self and mutual admittance values $Y_{i,i}$ and $Y_{i,i+1}$ for each of the resonators $R_i$;

(c) estimating a value of $W_i/H_i$ for each resonator $R_i$;

(d) obtaining a value of $S_{i,i+1}/H_i$ for each pair of adjacent resonators $R_i,R_{i+1}$ from a plot of $Y_{i,i+1}$ versus $S_{i,i+1}/H_i$ for a fixed value of $W_i/H_i$ estimated in step (c);

(e) obtaining a value of $Y_f$, where $Y_f$ is the end fringing admittance to the ground plane, for end resonator $R_1$ and for end Resonator $R_n$ from a plot of $Y_f$ versus $W_i/H_i$ for fixed values of $W_i/H_i$ estimated in step (c);

(f) obtaining a value of $Y_{fe}$, where $Y_{fe}$ is the center fringing even-mode admittance to the ground plane, for each resonator $R_i$ from a plot of $Y_{fe}$ versus $S_{i,i+1}/H_i$ for fixed values of $W_i/H_i$ by using the estimated fixed values of $S_{i,i+1}/H_i$ from step (d);

(g) calculating a value of $Y_{pp}$, where $Y_{pp}$ is the parellel-plate admittance to the ground plane, for each end resonator $R_1$ and $R_n$ using the equation $Y_{pp}=Y_{i,i}-Y_f-Y_{fe}$ and for each middle resonator $R_i$, where $1<i<n$ using the equation $Y_{pp}=Y_{ii}-Y_{fei,i-1}-Y_{fei,i+1}$ for the fixed values of $Y_{i,i}$ calculated in step (b), $Y_f$ obtained in step (e) and $Y_{fe}$ obtained in step (f);

(h) obtaining a value of $W_i/H_i$ for each resonator $R_i$ from a plot of $Y_{pp}$ versus $W_i/H_i$ for a fixed value of $Y_{pp}$ calculated in step (g); and (i) repeating steps (d)-(h) above until the last obtained $W_i/H_i$ is within a predetermined percent of the next precedings $W_i/H_i$ and the last obtained $S_{i,i+1}/H_i$ is within a predetermined percent of the next preceding $S_{i,i+1}/H_i$.

2. The method as defined in claim 1 wherein the Matthaei, et al. method is used in step (a).

3. The method as defined in claim 1 wherein the Cristal method is used in step (a).

4. The method as defined in claim 1 further comprising the step of obtaining the value of $L_i$ for each resonator $R_i$ with respect to the value of $W_i/H_i$ so that each resonator $R_i$ is approximately an electrical $\lambda/4$ at $f_o$.

5. A non-TEM-mode interdigital filter having n sections, where n is a positive integer, and having substantially the following electrical characteristics of: $f_o$, where $f_o$ is the center frequency of the passband; $\delta$, where $\delta$ is the maximum ripple of the passband is dB; $\Delta f$, where $\Delta f$ is the frequency size of the passband at $\delta$; $\Omega_{IN}$, where $\Omega_{IN}$ is the filter input impedance; and $\Omega_{OUT}$, where $\Omega_{OUT}$ is the filter output impedance, said filter comprising:

(a) an electrical ground plane;

(b) a dielectric disposed on one side of said ground plane; and (c) at least n separate interdigital resonators $R_i$ (where i goes from 1 to n) made of electrically conductive material, and each resonator $R_i$ having an electrical length approximately equal to $\lambda/4$ at the center frequency $f_o$ of the passband, each said interdigital resonator separated from said ground plane a distance $H_i$ by said dielectric, each said interdigital resonator having a separate and preselected width $W_i$, said interdigital resonators arranged and electrically connected in an interdigital fashion, each said pair of adjacent interdigital resonators $R_i,R_{i+1}$ being separated by a separate and preselected distance $S_{i,i+1}$, and wherein the values of $W_i$, $H_i$ and $S_{i,i+1}$ are selected by the following method comprising the steps of:

(i) calculating the self and mutual capacitances representing each of the resonators $R_i$ based on the values of $f_o$, $\delta$, $\Delta f$, $\Omega_{IN}$ and $\Omega_{OUT}$;

(ii) multiplying each of the self and mutual capacitances from step (i) by the velocity of light to obtain the self and mutual admittance values $Y_{i,i}$ and $Y_{i,i+1}$ for each of the resonators $R_i$;

(iii) estimating a value of $W_i/H_i$ for each resonator $R_i$;

(iv) obtaining a value of $S_{i,i+1}/H_i$ for each pair of adjacent resonators $R_i,R_{i+1}$ from a plot of $Y_{i,i+1}$ versus $S_{i,i+1}/H_i$ for a fixed value of $W_i/H_i$ estimated in step (iii);

(v) obtaining a value of $Y_f$, where $Y_f$ is the end fringing admittance to the ground plane, for end resonator $R_1$ and for end resonator $R_n$ from a plot of $Y_f$ versus $W_i/H_i$ for fixed values of $W_i/H_i$ estimated in step (iii);

(vi) obtaining a value of $Y_{fe}$, where $Y_{fe}$ is the center fringing even-mode admittance to the ground plane, for each resonator $R_i$ from a plot of $Y_{fe}$ versus $S_{i,i+1}/H_i$ for fixed values of $W_i/H_i$ by using the estimated fixed values of $S_{i,i+1}/H_i$ from step (iv);

(vii) calculating a value of $Y_{pp}$, where $Y_{pp}$ is the parallel-plate admittance to the ground plane, for each end resonator $R_1$ and $R_n$ using the equation $Y_{pp}=Y_{i,i}-Y_f-Y_{fe}$ and for each middle resonator $R_i$, where $1<i<n$, using the equation $Y_{pp}=Y_{ii}-Y_{fei,i-1}-Y_{fei,i+1}$ for the fixed values of $Y_{i,i}$ calculated in step (b), $Y_f$ obtained in step (e) and $Y_{fe}$ obtained in step (f);

(viii) obtaining a value of $W_i/H_i$ for each resonator $R_i$ from a plot of $Y_{pp}$ versus $W_i/H_i$ for a fixed value of $Y_{pp}$ calculated in step (vii); and (ix) repeating steps (iv)-(viii) above until the last obtained $W_i/H_i$ is within a predetermined percent of the next preceding $W_i/H_i$ and the last obtained $S_{i,i+1}/H_i$ is within a predetermined percent of the next preceding $S_{i,i+1}/H_i$.

6. The non-TEM-mode interdigital band-pass filter as recited in claim 5 wherein said dielectric is homogeneous.

7. The non-TEM-mode interdigital band-pass filter as recited in claim 5 wherein said interdigital resonator is in microstrip.

8. The non-TEM-mode interdigital band-pass filter as recited in claim 5 wherein said propagation medium is $Al_2O_3$.

9. The non-TEM-mode interdigital band-pass filter as recited in claim 5 wherein the first and last interdigital resonators are replaced by electric taps on said second and on said second-to-last interdigital resonators to provide input and output impedance matching, respectively.

10. The filter as defined in claim 5, wherein the Matthaei, et al. method is used to calculate the self and mutual capacitances representing each of the resonators $R_i$.

11. The filter as defined in claim 5, wherein the Cristal method is used to calculate the self and mutual capacitances representing each of the resonators $R_i$.

* * * * *